US007813821B1

(12) United States Patent
Howell

(10) Patent No.: US 7,813,821 B1
(45) Date of Patent: Oct. 12, 2010

(54) SYSTEM, METHOD AND COMPUTER PROGRAM PRODUCT FOR DETERMINING A TENNIS PLAYER RATING

(76) Inventor: David Howell, 2024 Thomas Bishop La., Virginia Beach, VA (US) 23454

( * ) Notice: Subject to any disclaimer, the term of this patent is extended or adjusted under 35 U.S.C. 154(b) by 1291 days.

(21) Appl. No.: 11/265,009

(22) Filed: Nov. 2, 2005

(51) Int. Cl.
*A63F 13/00* (2006.01)

(52) U.S. Cl. ..... 700/91; 473/415; 463/7; 273/317.4

(58) Field of Classification Search ..... 700/91–93; 473/415; 463/7; 273/317.4
See application file for complete search history.

(56) References Cited

U.S. PATENT DOCUMENTS

| | | | | |
|---|---|---|---|---|
| 6,425,828 | B2 | 7/2002 | Walker et al. | |
| 6,587,740 | B2 | 7/2003 | Byrne et al. | |
| 7,050,868 | B1 * | 5/2006 | Graepel et al. | 700/93 |
| 7,097,559 | B2 * | 8/2006 | Okita et al. | 463/11 |
| 2005/0209717 | A1 * | 9/2005 | Flint et al. | 700/91 |

OTHER PUBLICATIONS

"How are Ratings Calculated?", Nov. 27, 2003, http://web.archive.org/web/20040426084716/http://www.wetennis.com/rate.htm.*

"Self Rate with the NTRP", Oct. 24, 2002, http://web.archive.org/web/20040529153146/www.midatlantic.usta.com/communitytennis/fullstory.sps?iNewsID=18113&itype=&iCategoryID=.*

International Tennis Federation, "Rating the world—The ITF International Tennis No. (ITN)"; 11-pages; downloaded from Internet Sep. 2005.

* cited by examiner

*Primary Examiner*—James S McClellan
*Assistant Examiner*—Lawrence Galka
(74) *Attorney, Agent, or Firm*—Stephen E. Clark

(57) ABSTRACT

Systems, methods and computer program products for determining a player rating for at least one tennis player enhances the tennis playing experience of by matching tennis players of comparable tennis skills. The methodology comprises assigning numerical player ratings generally corresponding to each player's individual tennis skill level. A competitive threshold is established, corresponding to a minimum number of games that a player must win in a match between players having the same player rating. A player is considered to be competitive within a rating level, regardless of whether the player wins or loses matches, provided the player wins at least the minimum number of games that corresponds to the established competitive threshold. Adjustments are made to a player's rating only if/when the player has a sustained record of "non-competitive" matches with similarly rated players.

3 Claims, 4 Drawing Sheets

SYSTEM, METHOD AND COMPUTER PROGRAM PRODUCT FOR DETERMINING A TENNIS PLAYER RATING

BACKGROUND OF THE INVENTION

1. Field of the Invention

The present invention relates generally to computer-based athlete performance rating systems and methods. More particularly, the present invention relates to computer-based systems and methods of rating tennis players.

2. Description of the Prior Art

As with most sports, the game of tennis is often most enjoyable to play, and is nearly always most entertaining to watch, when the contesting players are evenly, or nearly evenly, matched with each other.

In an effort to identify players of comparable skill levels, numerous player rating systems have been proposed and used in the past. The United States Tennis Association (USTA) has developed the National Tennis Rating Program (NTRP), which is widely used throughout the United States. The International Tennis Federation (ITF) has developed the International Tennis Number (ITN), which is widely used outside of the United States. In both of these prior systems, players having identical rating numbers (or "ratings") are purported to be of comparable skill level. In theory, when players having identical ratings under such prior systems face each other in tennis matches, the matches are expected to be competitive.

Despite the wide use of the NTRP and ITF rating systems, many (if not most) amateur tournament tennis matches, even those in which tournament participation is restricted to players having identical player ratings under such prior systems, are notoriously non-competitive. That is, in such matches one player badly beats an opponent, as evidenced most noticeably by a lopsided match score.

A common cause of such non-competitive tennis matches relates to the difficulty in identifying in advance whether potential opponents are equally skilled or equally proficient at playing tennis. This is particularly the case when the potential opponents have not previously (and recently) played each other.

While the NTRP and ITF (and similar prior) tennis player rating systems attempt to identify tennis players who, if they were to play each other, would likely be competitive with one another, such prior systems, in practice, quite frequently fail to achieve that end.

There are several reasons why the use of NTRP and ITF (and similar prior) tennis player rating systems frequently fail to facilitate setting up of predictably competitive matches between players of comparable tennis skill and proficiency, particularly when the players have not recently played each other.

One problem with prior tennis player rating systems is that they all fundamentally rely on a subjective analysis of each player's tennis skills. Because such prior systems fundamentally rely on a subjective analysis of each player's tennis skills, the player's rating is inherently subjective. Because, under such prior systems, each player's rating is inherently subjective, there is considerable opportunity for errors/variations in assigning rating numbers to individual players. Such errors/variations in assigning rating numbers increase the likelihood of non-competitive matches between players having the same rating number.

Because, under such prior systems, each player's rating is inherently subjective, there is considerable opportunity for a single player's rating to be judged differently by different people. Similarly, under such prior systems, there are often discrepancies between the rating that a player is assigned (by a second party) and the rating that the player assigns to himself. Such discrepancies increase the likelihood of non-competitive matches between players having the same rating number.

Because, under such prior systems, each player's rating is inherently subjective, players of comparable tennis skill and proficiency levels who receive ratings in different geographic areas are frequently assigned different ratings. Such assignment of different ratings to players in different geographic areas increases the likelihood of non-competitive matches between players having the same rating number.

Another problem with such prior systems is that player ratings are predominantly influenced by, and in many cases entirely based on, players' tennis skills (such as proficiency at hitting hit drop shots, forehand ground stokes, backhand ground strokes, overheads, lobs, serves, etc.), rather than on the outcome of matches played. Because, under such prior systems, the ratings are based predominantly (if not entirely) on observing each player's playing skills, rather than on match outcomes, it is not uncommon for the outcome of matches between similarly-rated players to be lopsided (for example, in favor of the player who is more "tournament tough" or match-savvy).

Another problem with prior tennis rating systems is that each rating level is typically defined by a general grouping of a plurality of specific tennis player skills. It is, of course, possible that a tennis player who has mastered, say, an accurate, high-speed, un-returnable service (a characteristic, under prior rating systems, of a typically highly rated player) has, say, an exceptionally poor backhand (a characteristic, under prior rating systems, of a typically lowly rated player). Because such a player has specific tennis skills that, under prior rating systems, are associated with different rating levels, it is difficult to assign such a player a meaningful rating under such prior rating systems. Such difficulty, under prior rating systems, to assign meaningful ratings to players having skill sets that are different pre-established skill-set groupings, increases the likelihood of non-competitive matches between players having the same rating number.

Because rating levels in such prior rating systems are defined by specific groupings of a plurality of tennis player skills, there can be a relatively wide (competitiveness) range of players within each rating grouping. Furthermore, in the absence of input regarding actual match outcomes between players within the same rating group, it is difficult, under such prior rating systems alone, to split a rating group into sub-groups (i.e., with different ratings) that comprise only players who, predictably, would be competitive with one another. Such difficulty to split up (i.e., identify) players within a rating group into sub-groups increases the likelihood of non-competitive matches between players having the same rating number.

Another problem with prior rating systems is that, because they are predominantly (if not entirely) based on analyses of each player's tennis skills level, it is impractical, if not impossible, to make real-time, (or nearly real-time) adjustments in each player's rating as such adjustments (under prior rating systems) would only be assignable after conducting an analysis of the player's current tennis skill sets, and a rating adjustment would only be warranted if such analysis concluded that there is noticeable change in the player's tennis skills. Such impracticality (if not impossibility) to make real-time adjustments to players' ratings increases the likelihood of non-competitive matches between players having the same rating number.

An inherent attribute of player rating systems is the ability to "rank" players of different rating levels based on their respective ratings. That is, in prior rating systems, such as the NTRP system, a player who has few tennis skills would have a low rating, and a player who has highly developed tennis skills would have a high rating. It can easily be inferred that, in an "open" tournament, a highly rated player would be higher ranked than a lowly rated player. In theory, then, it is possible to rank players based, at least in part, by their individual ratings. A problem with such prior rating systems, however, is that player rankings are not readily affected by recent match outcomes.

OBJECTS AND SUMMARY OF THE INVENTION

In light of the foregoing background, the present invention provides systems, methods and computer program products for determining a player rating for at least one tennis player. The systems, methods and computer program products of the present invention enhance the tennis playing experience of tennis players by providing a method by which tennis players can compare themselves to their peers with a consistent comparison methodology that accounts for their relative tennis-playing ability and tennis match competitiveness.

In this regard, it is an object of the present invention to provide systems, methods and computer program products for determining respective tennis player ratings for multiple tennis players, wherein the tennis player ratings serve to identify potential tennis player match-ups that would likely, and predictably, result in competitive matches between so-identified tennis players.

It is another object of the present invention to provide systems, methods and computer program products of the character described wherein determination of a tennis player's rating is not based entirely on subjective data, but, instead, is determined at least in part based on objective, quantifiable player-specific data.

It is another object of the present invention to provide systems, methods and computer program products of the character described wherein determination of a tennis player's rating is not susceptible to discrepancies or variations resulting from human misinterpretation of such player-specific data.

It is another object of the present invention to provide systems, methods and computer program products of the character described wherein determination of a tennis player's rating depends, at least in part, on that player's tennis match scores against other closely or identically rated tennis players.

It is another object of the present invention to provide systems, methods and computer program products of the character described wherein a tennis player's rating can readily be evaluated and confirmed (or revised) immediately after playing each tennis match, thereby facilitating contemporaneous maintenance of a player's rating that accurately reflects the player's current level of performance and competitiveness.

It is another object to provide an embodiment of the present invention in which players of a relatively broadly identified rating group can be readily sub-divided into more narrowly identified rating groups, so as to facilitate even more competitive matching of potential tennis opponents.

It is another object to provide an embodiment of the present invention in which player "rankings" can be determined and readily updated, at least as between players having different ratings, based on recent match outcomes.

According to one embodiment of the invention, a system for determining at least one tennis player rating for at least one tennis player includes a processing element and an output element. The processing element is capable of receiving tennis player-specific information, wherein the tennis player-specific information is associated with at least one definable tennis skill or skill set and at least one tennis match score; and, based on at least a portion of the tennis player-specific information, the processing element can determine the tennis player rating for the tennis player.

In a preferred embodiment of the invention, the tennis-player specific information includes data representative of the closeness (or, alternatively, the "lopsidedness") of previous tennis matches between two rated players.

In another embodiment, the system further includes at least one electronic database, which is responsive to the processing element.

And in a further embodiment, the electronic database communicates with the processing element across a wide area network (WAN), such as the Internet. The electronic databases can store the tennis player-specific information based upon the tennis player-specific information received by the processing element.

It is another object to provide an embodiment of the present invention wherein the electronic databases are capable of storing multiple tennis player ratings.

It is another object to provide an embodiment of the present invention wherein the output element, which is also responsive to the processing element, is capable of outputting the tennis player ratings, such as a graphical user interface displaying the tennis player ratings.

Other objects, features and advantages of the present invention will become readily apparent from the following detailed description of the preferred embodiment when considered with the attached drawings and the appended claims.

DETAILED DESCRIPTION OF THE PREFERRED EMBODIMENT

Figure 1:
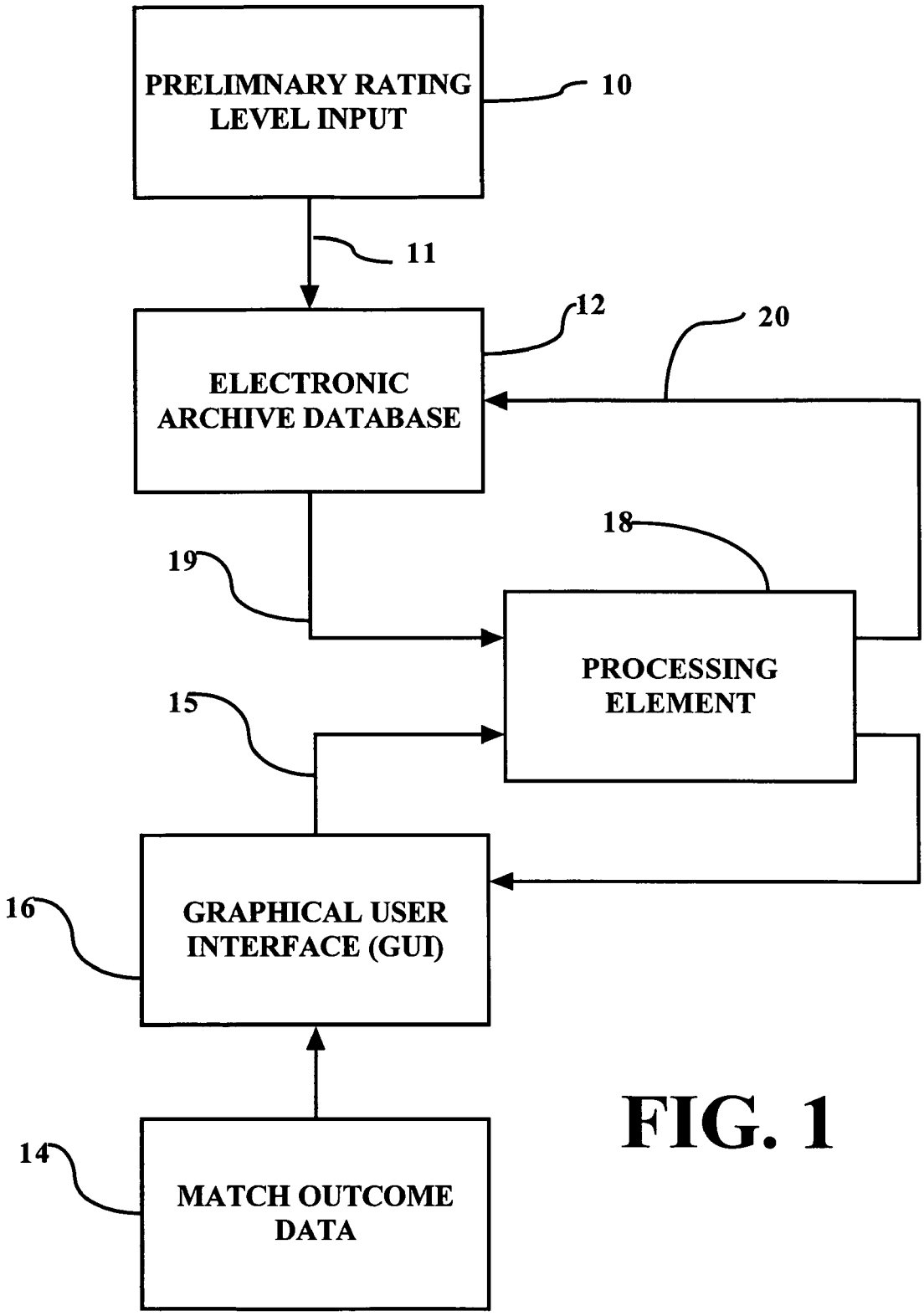
FIG. 1 is a block diagram of a system for determining a tennis player rating for at least one tennis player, according to one embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As will be described more fully herein below, the present invention provides systems, methods and computer program products for determining a player rating for at least one tennis player. For the purpose of explanation, the preferred embodiment of the invention is herein described wherein a player rating scale that ranges from 1 to 12, in increments of 1, is employed. Generally, the lower the "rating" the lower the skill and competitive level of the player; and, conversely, the higher the "rating" the higher the skill and competitive level of the player. As will become evident from reading the following description, alternative rating scales, having different ranges and different increments, can similarly be used without departing from the spirit of the present invention.

In the preferred embodiment of the invention, a rating scale is initially established wherein respective rating numbers generally correspond to the following tennis player skill levels:

Level 1: There are 3 criteria to be level one. First, the player must be able to serve from the baseline; second, the player must be able to return a serve that is hit from the baseline; and third, the player must be able to play the ball on one bounce. Players at this level get along just fine being able to bump the ball over the net and keep a short rally going. They often have trouble with short fluky balls, and often they stand just inside the baseline and get hurt by balls, which are in their "blind spot".

Level 2: Players at this level will consistently beat Level 1 players. Level 2 players do a better job of anticipating the short fluky shot. They also tend to not get stuck just inside the baseline. It is typical that Level 2 players can sustain long rallies, especially off the forehand side. Backhands are less well developed, but they seem able to defend well enough off the backhand side. Serving is reliable, but not powerful.

Level 3: Players at this level have no difficulty with 6 game sets, and tiebreakers. There may be a big range in terms of tennis skills. Some players may have few skills, but make do with their athleticism. Others are starting to develop defined strokes. The Level 3 player now has little trouble beating Level 2 players.

Level 4: Young Level 4 players are quite good for their age. It is not unusual to see Level 4 players with very advanced, well-rounded skills. Often these players are showing signs of being able to volley and hit overheads, though with little power or decisiveness. Older Level 4 players are often able to compete despite not having acquired a good balance of well-defined tennis skills. It is fun to watch a younger more well-rounded and steady player competes with older players who are able to cover the court better and assert their physical superiority. These matches are often very close. A Level 4 player will consistently beat the Level 3 player without allowing the competitive threshold (as will be described more fully herein below) to be met.

Level 5: The adults at this level may be vulnerable in many areas, but will usually be able to perform one tennis skill fairly well. This may include a good slice backhand, decent serve, or a drop shot. Young juniors at the level are very good for their age, but still may have trouble with adults whose games are not at good as theirs. Many older level 5 juniors will improve and become more consistent if they simple play more tennis. Often players at this level have problems with technical development in certain areas. They may have good ground strokes, but an undeveloped serve. If they do have a good overall game, consistency and shot selection can be problematic.

Level 6: Players at this level may have very advanced skills. Court coverage and anticipation are well developed. These players are familiar with a wide variety of strokes and spins. At this stage players may be able to set points up using their serve. Level 6 players may often make tactical mistakes and "throw away" too many points. When they do rely on consistency, they may often underplay. While these players may have a lot of variety in their games, they often do not possess the confidence to use their shots in close matches. Consistency usually wins at this level.

Level 7: Level 7 players are good all-around and usually have some outstanding characteristic in their game. While they often have outstanding aspects in their games, they also usually have some part of their game that does not hold up well under pressure. For example, a Level 7 player may have good overhead technique, but often has problems executing in match play situations. They often do well in practice, but fail to perform in competition.

Level 8: Players at this level are very accomplished with fully developed games. They may range in age from 15 to 60 with the players at either extreme being very good for their age. A Level 8 player under the age of 15 will be a very solid talent. This will be the kind of player who has potential to play Division 1 NCAA tennis or beyond. Adult Level 8's may have reached their peak, which they may maintain for a very long time. For an Adult Level 8 to move beyond this level often takes a tremendous commitment to fitness, practice and play. Junior girls who have reached this level will normally have a national ranking and be preparing for Division 1 NCAA tennis. Players at this level may have technical problems in their games, but they have usually learned how to cope with these problems and compensate successfully in some way.

Level 9 and 10: Players at these two levels all have very advanced games, have strong weapons, and can cover up their weaknesses. The practical distinction between players in Level 9 and Level 10 is that Level 9 players' matches do not achieve the competitive threshold when playing Level 10 players; the difference in the players' skills being almost imperceptible, with the match outcomes most often being in favor of the player who has been playing most frequently. These players are usually among the best players in an area. Junior players at these levels are highly likely to play Division 1 NCAA tennis. Junior girls will be among the top players nationally. Adults at this level may maintain this standard into his or her fifties if they are sufficiently motivated. These are very talented individuals. Females at this level will be very accomplished. These players are often motivated by the "love of the game".

Level 11 and 12: This is the Championship Level. The practical distinction between players in Level 11 and Level 12 is that Level 11 players' matches do not achieve the competitive threshold when playing Level 12 players; the difference in the players' skills being almost imperceptible, with the match outcomes most often being in favor of the player who has been playing most frequently. Prize money events may motivate players at these levels. Juniors who reach this level will be highly ranked sectional players and also have significant national rankings. Most of the players who make up this category are former or current Division 1 NCAA players in their twenties to early thirties. Only the most motivated and talent players in their thirties will maintain this level. Females at this level will be extraordinary. Local players who can exceed this level typically are either current NCAA Division 1 players or are players who are contemplating playing professional tennis as a career.

As will become evident from the following description, the above player level descriptions are used principally as a starting point by which to assign a Preliminary Rating Level to each new player. In accordance with the present invention, tennis players' ratings thereafter are determined, validated, and, if necessary, adjusted by a processing element based on actual tennis match outcomes between players whose player-specific information is stored in a database.

Referring to FIG. 1, the method by which a player is rated in accordance with the preferred embodiment of the present invention is described: A Preliminary Rating Level 10 is assigned to each new (i.e., previously un-rated) player and is input 11 to an electronic archive database 12. The electronic archive database 12 stores player-specific information for each of a plurality of tennis players. The "player-specific" information preferably includes at least the player's name, his/her age (or age group), and his/her current player rating level. Each player in the database is referred to herein as a "rated player".

The Preliminary Rating Level 10 that is initially assigned to the new player is the player rating level whose description (per above) best corresponds to that player's tennis skills set. For example, if a new player entering the system is an adult who has a good slice backhand, but doesn't play much and has a poor serve, he/she might be assigned a Preliminary Rating Level of 5, based on the above description of Level 5 tennis skills.

Whenever a tennis match is played between two rated players, Match Outcome Data 14 relating to the results of each such match are preferably input 15 to a processing element 18 via a graphical user interface ("GUI") 16 (or other input/output element or elements). The Match Outcome Data 14 for each match preferably include at least the names (or identification number) of the players/contestants, the date of the match, and the score of the match.

The processing element 18 is capable of receiving tennis player information. The processing element can comprise any of a number of different devices, such as a personal computer or other high level processor. The electronic archive database 12 is capable of storing the tennis player information, including match outcomes. To communicate, the processing element 18 and the electronic archive database 12 are in electrical communication. In this regard, the processing element 18 and electronic archive database 12 can communicate in a number of different manners but, in a preferred embodiment, communicate via a wide area network (WAN), such as the Internet. As a result, in one typical configuration, the processing element 18 and GUI 16 reside at a location proximate a tennis player who inputs Match Outcome Data 14 into the processing element 18. In an alternate configuration, the processing element 18 is accessible only to the system administrator(s), who control(s) information flow between the processing element 18 and the GUI 16 and/or between the processing element 18 and the electronic archive database 12.

Referring still to FIG. 1: The processing element 18 analyzes the Match Outcome Data 14 for each match between two rated players by comparing, for each of the two players, the Match Outcome Data 14 that is input 15 (via the GUI 16) to the processing element 18 and the respective player-specific data that is input 19 to the processing element 18 from the electronic archive database 12. After analyzing the Match Outcome Data 14 and the player-specific information from the electronic archive database 12, the player-specific information that is stored in the electronic archive database 12 for each of the two players is updated, based on input 20 from the processing element 18.

Whenever a tennis match is played between rated players, the Match Outcome Data 14 is input 15 to the processing element 18 via the GUI 16. In the preferred embodiment of the invention, player-specific information, including the date of the match and the score of the match, is passed 20 from the processing element 18 to the electronic archive database 12, where the match scores and dates are compiled and stored for each rated player.

Whenever a tennis match is played between two rated players who, prior to playing the match, have the same Player Rating, the Player Rating Level of each of the players is re-assessed, and is either validated, raised or lowered, as appropriate based on an analysis conducted by the processing element 18. The protocol for conducting such an analysis is described below.

Figure 2:
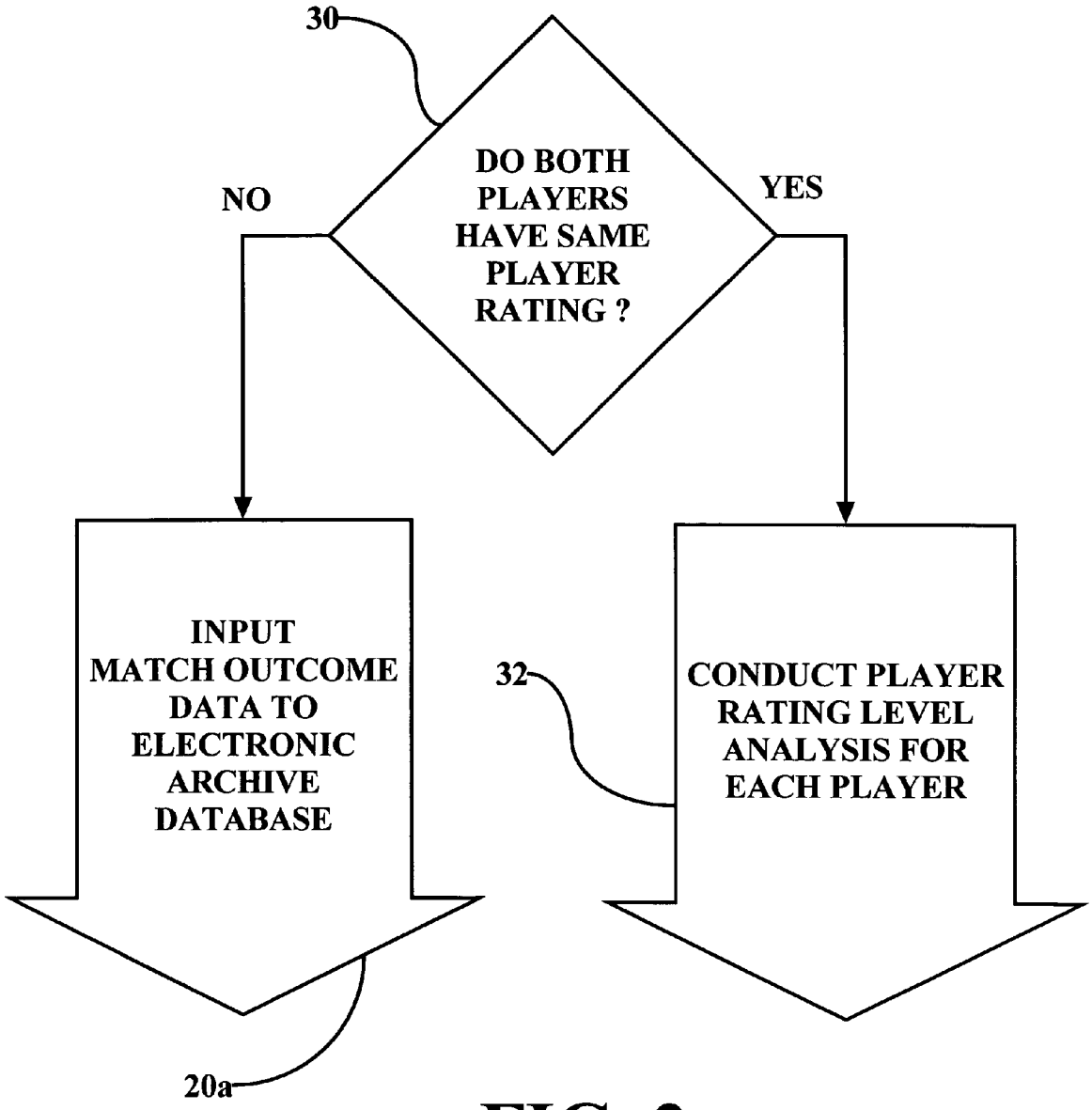
FIG. 2 is a flow chart illustrating various steps of a method of determining at least one tennis player rating according to one embodiment of the present invention; and, FIGS. 3*a* and 3*b* is a flow chart illustrating various steps of a method of determining at least one tennis player rating according to one embodiment of the present invention.

Referring now to FIGS. 1 and 2: Match Outcome Data 14 pertaining to a particular match between rated players is input 15 to the processing element 18, as shown in FIG. 1. The Match Outcome Data 14 includes, among other data, the name of the two players, the match score and the date of the match. Player-specific information, including, for example, current player rating and score of at least the most recent previous match, for each of the two players is input 19 from the Electronic Archive Database 12 to the Processing Element 18. The Processing Element 18 determines 30 whether, prior to playing the match, the two players had the same Player Rating, as illustrated in FIG. 2. If the players did not have the same Player Rating prior to playing the match, the match outcome data is simply input 20*a* to the electronic archive database 12 for archival purposes, as shown in FIG. 2.

If the two players of a singles tennis match did have the same Player Rating prior to playing the match, processing element 18 conducts 32 a Player Rating analysis for each of the two players, as shown in FIG. 2. The preferred protocol by which the processing element conducts 32 a Player Rating analysis for each of the tennis players is described as follows, and as illustrated in FIG. 3.

Figure 3A:
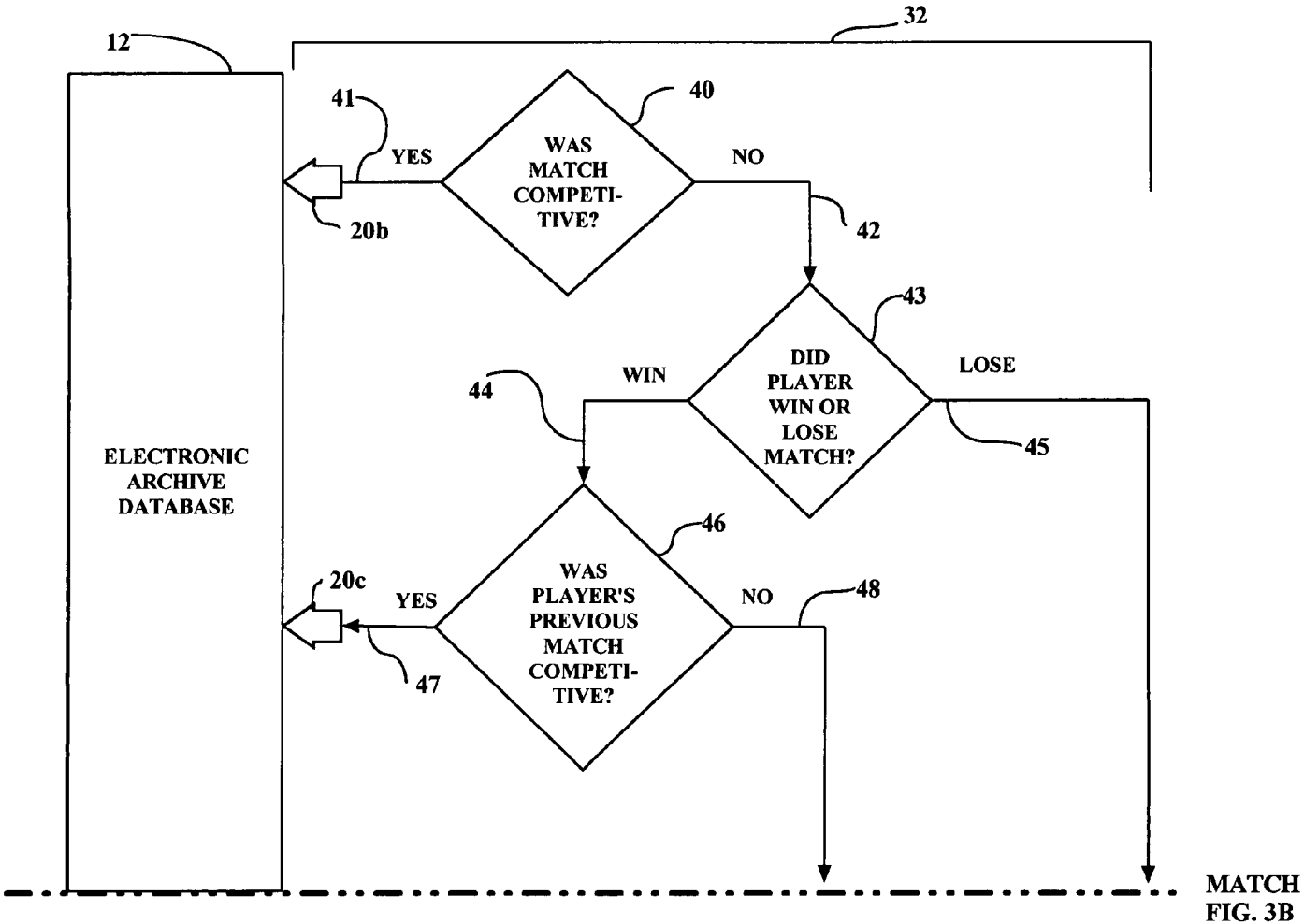
Figure 3B:
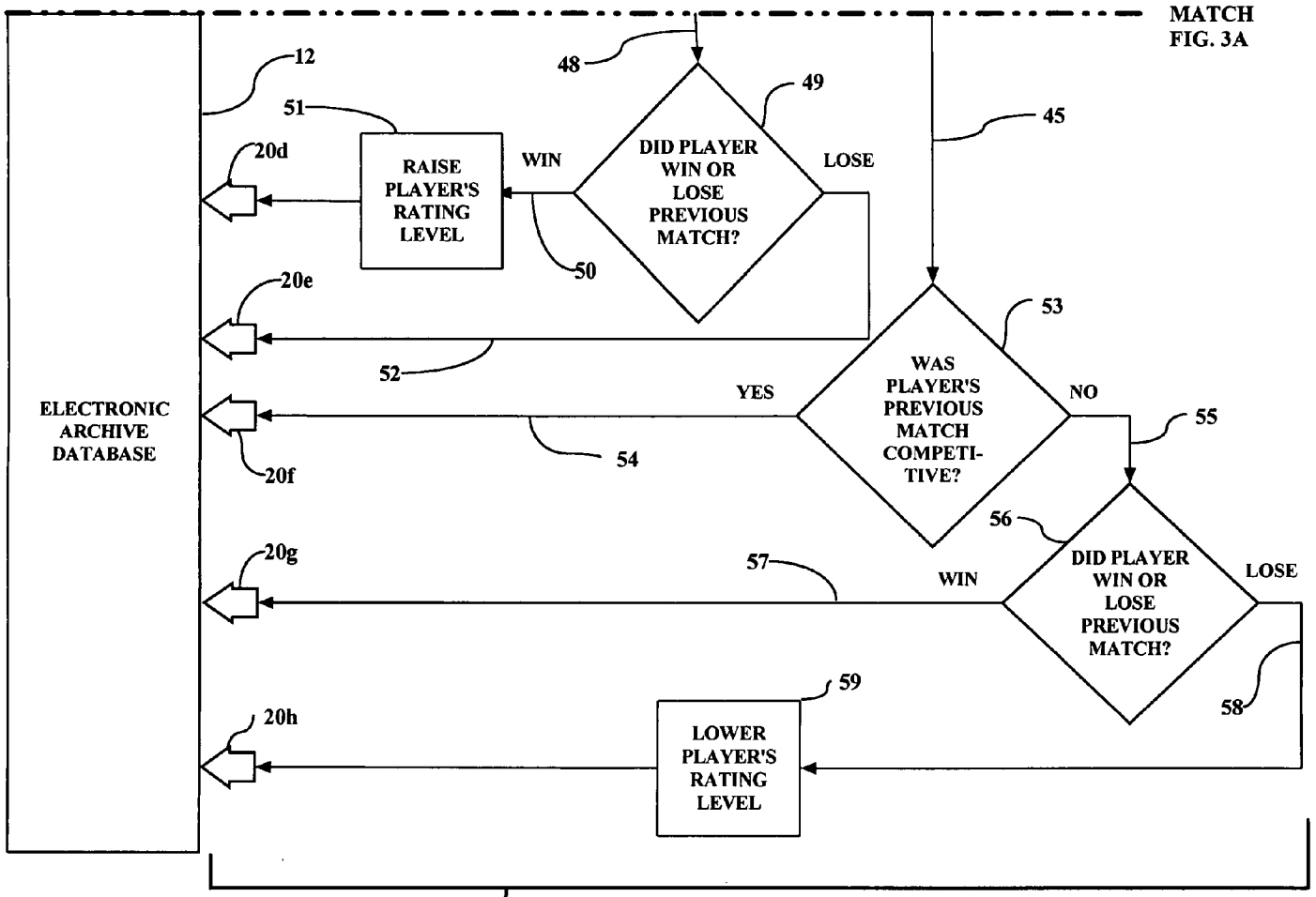

Referring now to FIG. 3: As discussed above, Match Outcome Data for a particular tennis match between two previously equally rated players is input to a processing element. The processing element first determines 40 whether the match was "competitive" or "non-competitive" as defined herein below. In the preferred embodiment of the invention, the processing element will determine that a match was "non-competitive" if, in a two-set tennis match (using a one-game set tiebreaker, if necessary) between rated players, the losing player did not win a total of at least seven games in the match. Thus, any match whose set scores are 6-0 and 6-0; or 6-0 and 6-1; or 6-1 and 6-1; or 6-1 and 6-2; or 6-2 and 6-2; or 6-2 and 6-3; or 6-3 and 6-3, is considered a "non-competitive" match.

On the other hand, in the preferred embodiment of the invention, the processing element will determine that a match was "competitive" if, in a two-set tennis match (using a one-game set tiebreaker, if necessary) between rated players, the losing player won a total of at least seven games in the match. Thus, any match whose set scores are 6-3 and 6-4; or 6-4 and 6-4; or 6-4 and 7-5; or 7-5 and 7-5; or 7-5 and 7-6; or 7-6 and 7-6, would be considered a "competitive" match.

If the match is determined 40 to have been competitive 41, the electronic archive database will be updated (via input 20*b* to the electronic archive database) to reflect that the losing player lost a competitive match, and that the winning player won a competitive match, on the date of the match, but the players' ratings will not be changed.

If the match is determined to have been non-competitive 42, the processing element will analyze player-specific information (input to the processing element from the electronic archive database) to determine whether the selected player's two most recent matches were both "non-competitive". In the preferred embodiment of the invention, if a player's two most recent matches were "non-competitive" the processor will adjust that player's Rating Level.

If, in his/her most recent matches, a player played and lost two non-competitive matches in a row, the player's rating level will be reduced by one level.

If, in his/her most recent matches, a player played and won two non-competitive matches in a row, the player's rating level will be raised by one level.

If, in at least one of his/her two most recent tennis matches, a player played at least one competitive match (regardless of whether he/she won the competitive match), the player's rating level will be validated and will remain unchanged.

Referring still to FIG. 3: In order for the processing element to determine whether or not an adjustment must be made to the selected player's rating, it determines 43 whether the player won or lost the (non-competitive) match. This determination 43 is based on the Match Outcome Data input to the processing element.

If the player won 44 the (non-competitive) match, the processing element then determines 46 whether the player's most recent previous match was competitive. This determination 46 is based on player-specific information input to the processing element from the electronic archive database.

If the player's most recent previous match was competitive 47, then the player's rating would remain unchanged (as the player would have played one non-competitive match and one competitive match in his/her last two matches), and the Match Outcome Data would be input 20*c* to the electronic archive database for archival storage.

If the player's most recent previous match was not competitive 48, then the processing element would determine 49 whether the player won or lost his/her most recent previous match. This determination 49 is based on player-specific information input to the processing element from the electronic archive database.

If the player won 50 his/her most recent previous match, then that player would have won his/her last two matches by non-competitive scores. Thus, the player's rating level is raised 51 by one level. Data, reflective of the Match Outcome Data and reflective of the player's new (i.e., higher) Player Rating, are input 20*d* to the electronic archive database for archival storage.

If the player lost 52 his/her most recent previous match, then that player would have had a non-competitive win and a non-competitive loss in his/her last two matches, and no adjustment in that player's rating would be appropriate that this time. Accordingly, the player's rating would remain unchanged, and the Match Outcome Data would be input 20*e* to the electronic archive database for archival storage.

If it is determined 43 that the player lost 45 this (non-competitive) match, the processing element then determines 53 whether the player's most recent previous match was competitive. This determination 53 is based on player-specific information input to the processing element from the electronic archive database.

If the player's most recent previous match was competitive 54, then the player's rating would remain unchanged (as the player would have had one non-competitive match and one competitive match in his/her last two matches), and the Match Outcome Data would be input 20*f* to the electronic archive database for archival storage.

If the player's most recent previous match was not competitive 55, then the processing element would determine 56 whether the player won or lost his/her most recent previous match. This determination 56 is based on player-specific information input to the processing element from the electronic archive database.

If the player won 57 his/her most recent previous match, then that player would have had a non-competitive loss and a non-competitive win in his/her last two matches, and no adjustment in that player's rating would be appropriate that this time. Accordingly, the player's rating would remain unchanged, and the Match Outcome Data would be input 20*g* to the electronic archive database for archival storage.

If the player lost 58 his/her most recent previous match, then that player would have had lost his/her last two matches by non-competitive scores. Thus, the player's rating level is lowered 59 by one level. Data, reflective of the Match Outcome Data and reflective of the player's new (i.e., lower) Player Rating are input 20*h* to the electronic archive database for archival storage.

It will be appreciated from an understanding of the above description of the present invention that, while there are descriptions of each rating level that are particularly useful in assigning a Preliminary Rating Level 10 to new (i.e., previously un-rated) players, the present invention provides a method of identifying players who not only generally beat the players who have lower ratings, but often do so without allowing the lower rated players to reach a competitive threshold. If a player loses a match by a score of 6-3, 6-3 or 6-3, 6-2, or by even less close scores, there is a high probability that that player is playing an opponent whose tennis skills are (or should be adjusted to become) at least one rating level higher than his/her own. If the player, however, can achieve a competitive threshold, (e.g., 6-3& 6-4, 6-4 & 6-4, 6-5 & 6-2), then, even though that player loses, the player is most probably playing opponents at the right (i.e., the same) level In the foregoing description, the preferred embodiment of the invention has been illustrated by explaining its operation when two rated adult players play two 6-game sets. A modification of the present invention is also adaptable for use for matches that are not based on two 6-game sets. Such modified embodiments of the invention are particularly useful for rating "junior" players, as well as for championship level (Levels 11 and 12) players.

Preferably, the first four rating levels (namely levels 1, 2, 3 and 4) are used exclusively for junior players.

For matches played between (junior) players having Player Ratings of Level 1 or Level 2, a modified scoring system is preferably used. Such Level 1 and Level 2 matches are preferably 4-game (i.e., first to win 4 games) sets, with 4-point set tiebreakers, and 6-point match tiebreakers.

For matches played between (junior) players having a Player Rating of Level 3 or 4, matches are preferably of 6-game (i.e., first to win six games) sets, with 7-point set tiebreakers, and 10-point match tiebreakers.

Starting with Level 5, there are preferably no age restrictions; and adults and juniors at the same rating level play in the same draws; and matches are preferably of 6-game sets, with 7-point set tiebreakers, and 10-point match tiebreakers, except for Level 11 and Level 12 players, at which all matches are preferably best of 3 sets, with the $3^{rd}$ set being played to its conclusion, and no match breakers.

It will be understood by those skilled in the art that the system, method and computer program product described herein above provide means for determining a tennis player rating based predominantly, if not entirely, on match outcomes between rated players. It will further be understood that the method and system of the present invention also provides a means for readily adjusting or affirming a player's rating immediately after each match.

It will also be understood that, in accordance with the present invention, adjustments to a player's rating level are not based on whether or not a player wins a match (or matches), but whether the match (or matches) played was (or were) "competitive", as defined herein.

Many modifications and other embodiments of the invention will come to mind to one skilled in the art to which this invention pertains having the benefit of the teachings presented in the foregoing descriptions and the associated drawings.

Modified embodiments of the invention. Although there has been shown and described the preferred embodiment of the present invention, it will be readily apparent to those skilled in the art that modifications may be made thereto which do not exceed the scope of the appended claims. For example:

Player identification numbers may be included in the player-specific-information instead of, or in addition to, a player's name.

Various "competitive thresholds" can be implemented in place of those described above. Namely, the minimum number of games that the losing player in a match must win in a two-set match, in order to be considered a "competitive" match, may alternatively be a number other than seven. But, in any event, in accordance with the present invention, the minimum number of games that a losing player must win in order for a match to be considered "competitive" is always less than the minimum number of games necessary to win the match. In addition, matches may be two out of three sets (or 3 out of five sets) rather than using set tiebreakers.

The number of consecutive non-competitive matches that must be won (or lost) in a row before triggering an automatic adjustment in a player's rating level may, alternatively, be other than two matches, as described above.

The tennis player information received by the processing element 16 can originate from any of a number of different sources and can include any of a number of different pieces of information.

The range and increments of the player rating level scale can be different from the twelve-increment scale described herein above. Furthermore, the player rating level scale can be reverse from that described herein above, such that low rating levels indicated tennis players with high tennis skills and high rating levels indicate players with low tennis skills.

The GUI 16, which can comprise any of a number of known devices, is responsive to the processing element 18 for displaying the player-specific information.

After the processing element 18 has received all of the Match Outcome Data, the processing element can save the Match Outcome Data into the electronic archive database 12. Thereafter, the processing element can display the tennis player information in any of a number of different manners, including displaying the information for an individual tennis player, or a listing of all rated tennis players and their corresponding player rating, or other information.

The dynamic electronic information can include any of a number of different graphical summaries for a selected player, such as historical match outcomes against selected opponents.

Whereas the aforementioned description provides one technique by which to determine the tennis player ratings, it should be understood that the described technique is merely illustrative of one technique of determining the tennis player ratings. In this regard, determining the tennis player ratings based upon at least a portion of the player-specific information can be accomplished according to any of a number of techniques without departing from the spirit and scope of the present invention.

In various advantageous embodiments, portions of the system and method of the present invention include a computer program product. The computer program product includes a computer-readable storage medium, such as the non-volatile storage medium, and computer-readable program code portions, such as a series of computer instructions, embodied in the computer-readable storage medium. Typically, the computer program is stored and executed by a processing unit or a related memory device, such as the processing element 18 as depicted in FIG. 1.

In this regard, FIGS. 1-3 are block diagrams and flowchart illustrations of methods, systems and program products according to the invention. It will be understood that each block or step of the block diagram, flowchart and control flow illustrations, and combinations of blocks in the block diagram, flowchart and control flow illustrations, can be implemented by computer program instructions. These computer program instructions may be loaded onto a computer or other programmable apparatus to produce a machine, such that the instructions that execute on the computer or other programmable apparatus create means for implementing the functions specified in the block diagram, flowchart or control flow block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the block diagram, flowchart or control flow block(s) or step(s). The computer program instructions may also be loaded onto a computer or other programmable apparatus to cause a series of operational steps to be performed on the computer or other programmable apparatus to produce a computer implemented process such that the instructions which execute on the computer or other programmable apparatus provide steps for implementing the functions specified in the block diagram, flowchart or control flow block(s) or step(s).

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagram, flowchart or control flow illustrations, and combinations of blocks or steps in the block diagram, flowchart or control flow illustrations, can be implemented by special purpose hardware-based computer systems which perform the specified functions or steps, or combinations of special purpose hardware and computer instructions.

Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

Accordingly, the scope of the invention should be determined by the appended claims and their legal equivalents, rather than by the examples given.

I claim:

1. A process for determining at least one tennis player rating level for at least one tennis player, comprising:

1) assigning a first rating value to a first tennis player;

2) assigning a first rating value to a first opponent;

3) assigning a first rating value to a second opponent;

4) defining a competitive threshold, said competitive threshold being associated with a total number of games to be won in a tennis match;

wherein said total number of games to be won in a tennis match associated with said competitive threshold is less than a number of games that is required to win said tennis match;

5) storing first match outcome data on an electronic archive database, said first match outcome data being indicative of a tennis match score of a first tennis match, said first tennis match being between said first tennis player and said first opponent;

6) communicating said first match outcome data to a processing element;

7) comparing said first match outcome data to said competitive threshold, wherein said step of comparing said first match outcome data to said competitive threshold is implemented by said processing element;

and wherein said step of comparing said first match outcome data to said competitive threshold comprises:

A) determining whether said first tennis player won or lost said first tennis match;

B) determining whether, in said first tennis match, said first tennis player won at least said total number of games associated with said competitive threshold;

C) determining whether, in said first tennis match, said first opponent won at least said total number of games associated with said competitive threshold;

8) storing second match outcome data on said electronic archive database, said second match outcome data being indicative of a tennis match score of a second tennis match, said second tennis match being between said first tennis player and said second opponent, and wherein said first tennis match was played prior to said second tennis match;

9) communicating said second match outcome data to said processing element;

10) comparing said second match outcome data to said competitive threshold, wherein said step of comparing said second match outcome data to said competitive threshold is implemented by said processing element;

wherein said step of comparing said second outcome data to said competitive threshold comprises:

A) determining whether said first tennis player won or lost said second tennis match;

B) determining whether, in said second tennis match, said first tennis player won at least said number of games associated with said competitive threshold;

C) determining whether, in said second tennis match, said second opponent won at least said number of games associated with said competitive threshold;

11) assigning a second rating value to said first tennis player based on comparison of said first match outcome data to said competitive threshold and based on comparison of said second match outcome data to said competitive threshold;

wherein said second rating value assigned to said first tennis player is equal to said first rating value of said first tennis player whenever said first tennis player loses said first tennis match and wins said second tennis match, regardless of the number of games won by said first tennis player in said first tennis match and regardless of the number of games won by said first tennis player in said second tennis match;

wherein said second rating value assigned to said first tennis player is equal to said first rating value of said first tennis player whenever said first tennis player wins said first tennis match and loses said second tennis match, regardless of the number of games won by said first tennis player in said first tennis match and regardless of the number of games won by said first tennis player said second tennis match;

wherein said second rating value assigned to said first tennis player is equal to said first rating value of said first tennis player whenever said first tennis player loses said first tennis match and loses said second tennis match and the number of games won by said first tennis player in said first or second tennis match is at least as great as said number of games associated with said competitive threshold;

wherein said second rating value assigned to said first tennis player is equal to said first rating value of said first tennis player whenever said first tennis player wins said first tennis match and wins said second tennis match and the number of games won by said first or second opponent in said first or second tennis match is as least as great as said number of games associated with said competitive threshold;

wherein said second rating value assigned to said first tennis player is lower than said first rating value of said first tennis player if and only if said first tennis player loses said first tennis match and the number of games won by said first tennis player in said first tennis match is less than said number of games associated with said competitive threshold, and said first tennis player loses said second tennis match and the number of games won by said first tennis player in said second tennis match is less than said number of games associated with said competitive threshold;

wherein said second rating value assigned to said first tennis player is higher than said first rating value of said first tennis player if and only if said first tennis player wins said first tennis match and the number of games won by said first opponent in said first tennis match is less than said number of games associated with said competitive threshold, and said first tennis player wins said second tennis match and the number of games won by said second opponent in said second tennis match is less than said number of games associated with said competitive threshold.

2. The process according to claim 1, wherein said first tennis match and said second tennis match are consecutive matches played by said first tennis player.

3. The process according to claim 2, wherein said first rating value assigned to said first tennis player and said first rating value assigned to said first opponent and said first rating value assigned to said second opponent are all the same value.

* * * * *